US005772199A

United States Patent [19]

Green

[11] Patent Number: 5,772,199

[45] Date of Patent: Jun. 30, 1998

[54] ENVELOPE FEEDING APPARATUS

[75] Inventor: Ronald J. Green, Reedsburg, Wis.

[73] Assignee: Streamfeeder, LLC, Minneapolis, Minn.

[21] Appl. No.: 634,195

[22] Filed: Apr. 18, 1996

[51] Int. Cl.[6] ..... B65H 5/00

[52] U.S. Cl. ..... 271/10.06; 271/225; 271/35; 271/245; 271/162; 271/171

[58] Field of Search ..... 271/2, 10.06, 10.07, 271/10.09, 10.1, 35, 225, 248, 250, 245, 162, 171

[56] References Cited

U.S. PATENT DOCUMENTS

| | | | |
|---|---|---|---|
| 3,733,068 | 5/1973 | Herring et al. | 271/225 X |
| 3,770,265 | 11/1973 | Gatti | 271/10.06 |
| 4,034,975 | 7/1977 | Agnew et al. | 271/225 X |
| 4,061,329 | 12/1977 | Sachuk et al. | 271/10.09 |
| 4,529,187 | 7/1985 | Einem et al. . | |
| 4,607,832 | 8/1986 | Abe . | |
| 4,720,960 | 1/1988 | Green . | |
| 4,991,831 | 2/1991 | Green . | |
| 5,143,365 | 9/1992 | Green . | |
| 5,244,198 | 9/1993 | Green . | |
| 5,340,097 | 8/1994 | Yankloski | 271/225 X |

*Primary Examiner*—Boris Milef
*Attorney, Agent, or Firm*—Bell Seltzer Intellectual Property Law Group of Alston & Bird LLP

[57] ABSTRACT

An apparatus for serially feeding envelopes along a longitudinal path of travel and which includes a support table, an envelope feeder mounted to the support table for feeding envelopes individually from the bottom of a vertical stack of envelopes in a lateral direction to an envelope receiving position on the table, and an envelope conveying system for feeding the envelopes from the envelope receiving position along a longitudinal path of travel and through a plurality of processing stations, such as a flap opening station and a product insertion station. The feeder is directly connected to a fixed envelope stop on the table by an adjustable linkage so as to define the envelope receiving position between the stop and the feeder, and so that the lateral position of the feeder may be readily adjusted on the table to change the dimension of the envelope receiving position and thereby accommodate envelopes of varying size.

13 Claims, 5 Drawing Sheets

ENVELOPE FEEDING APPARATUS

BACKGROUND OF THE INVENTION

The present invention relates to an envelope feeding apparatus which may be employed for serially feeding envelopes to a mail inserting machine or the like. An envelope feeding apparatus of the described type is presently being commercialized by Bell & Howell Corporation under the designation the Phillipsburg™ inserter, the basic features of which are described below in association with FIGS. 1 and 2 of the present application.

It is an object of the present invention to provide an improved envelope feeding apparatus of the described type and which is adapted to reliably and efficiently feed envelopes of varying size and dimensions to a mail inserting machine or other envelope processing devices.

It is also an object of the present invention to provide an envelope feeder which may be used to retrofit the above-described Phillipsburg™ inserter, to thereby provide an improved apparatus for feeding envelopes through a series of processing stations.

SUMMARY OF THE INVENTION

The above and other objects and advantages of the present invention are achieved by the provision of an envelope feeding apparatus which comprises a support table which includes a generally flat upper surface. An envelope stop is fixed to the upper surface of the support table so as to define a longitudinal direction and a lateral direction which is perpendicular thereto, and an envelope feeder is positioned on the upper surface of the support table at a location laterally spaced from the stop so as to define an envelope receiving position therebetween. The envelope feeder acts to serially deliver envelopes in a lateral direction into engagement with the stop and so as to overlie the envelope receiving position. An envelope conveying means is mounted to the support table for separately conveying each envelope received at the envelope receiving position along a longitudinal path of travel on the upper surface, and so as to transport the envelope through a series of processing stations.

In the preferred embodiment, the envelope feeder and the support table are interconnected so as to permit the lateral spacing between the envelope feeder and the stop to be adjusted to thereby vary the lateral dimension of the envelope receiving position and accommodate envelopes of varying size. This interconnection may take the form of an adjustable linkage directly interconnecting the stop and the envelope feeder, with the linkage serving not only to retain the feeder on the support table but also to maintain the lateral alignment of the feeder with the stop.

BRIEF DESCRIPTION OF THE DRAWINGS

Some of the objects and advantages of the present invention having been stated, others will appear as the description proceeds, when considered in conjunction with the accompanying drawings, in which.

DESCRIPTION OF A KNOWN ENVELOPE FEEDER

Figure 1:
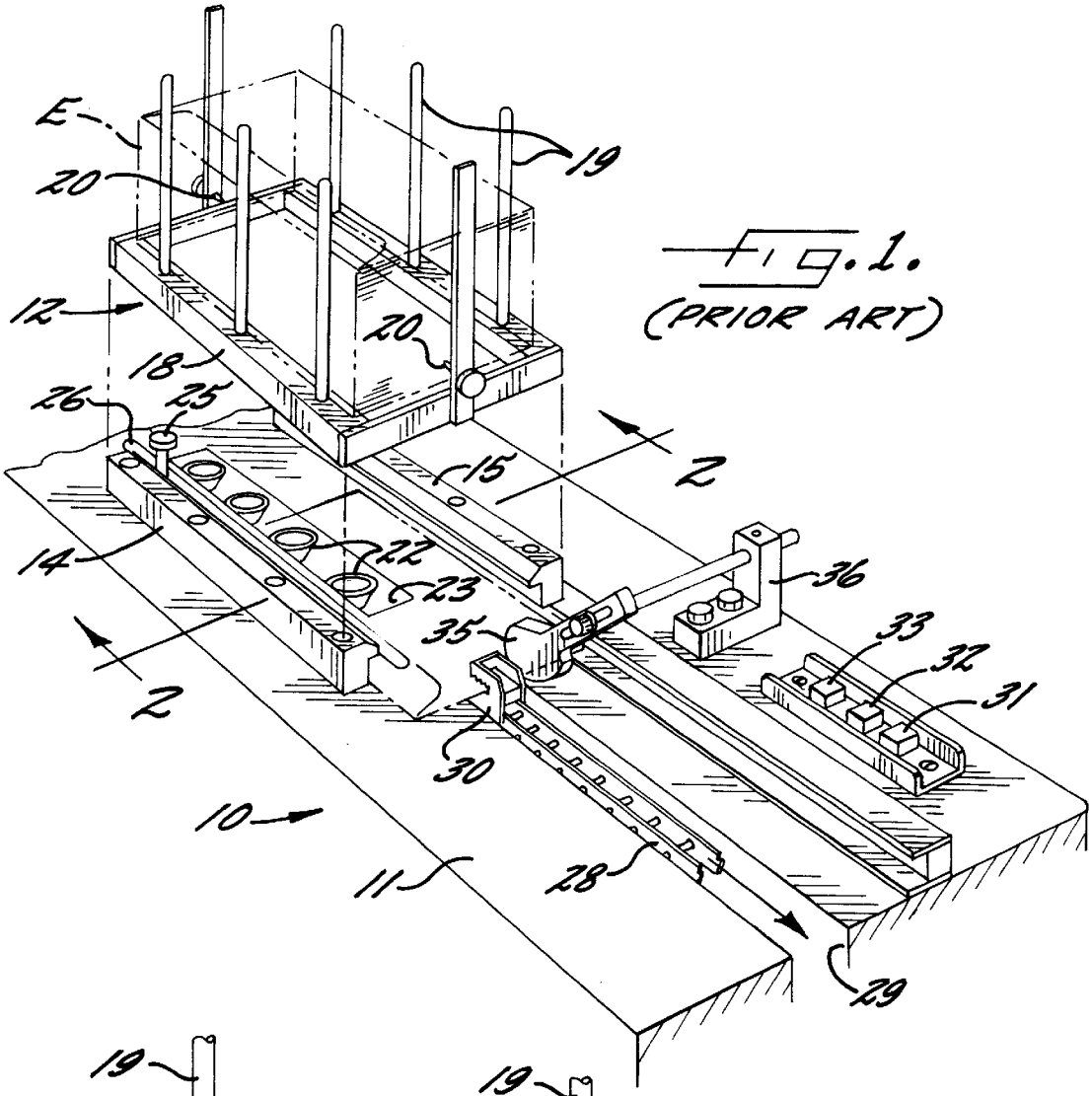
Fig. 1. (PRIOR ART)
FIG. 1 is a partly schematic perspective view of an envelope feeding apparatus in accordance with the prior art.
Figure 2:
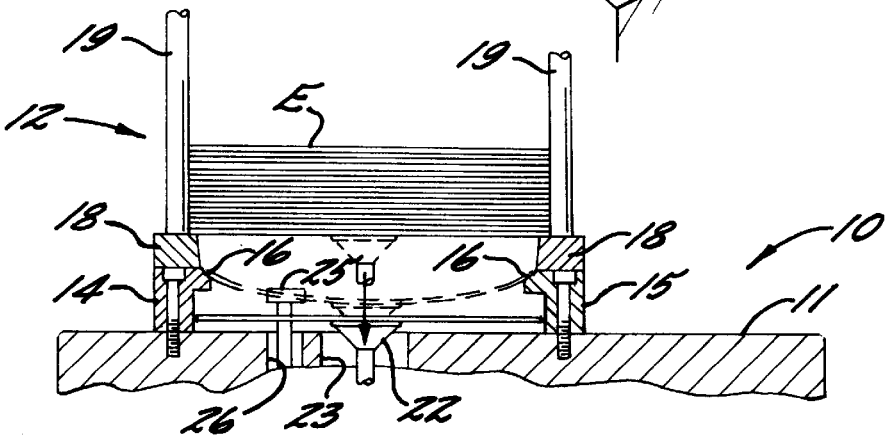
Fig. 2. (PRIOR ART)
FIG. 2 is a sectional view taken substantially along the line 2—2 of FIG. 1.
Figure 3:
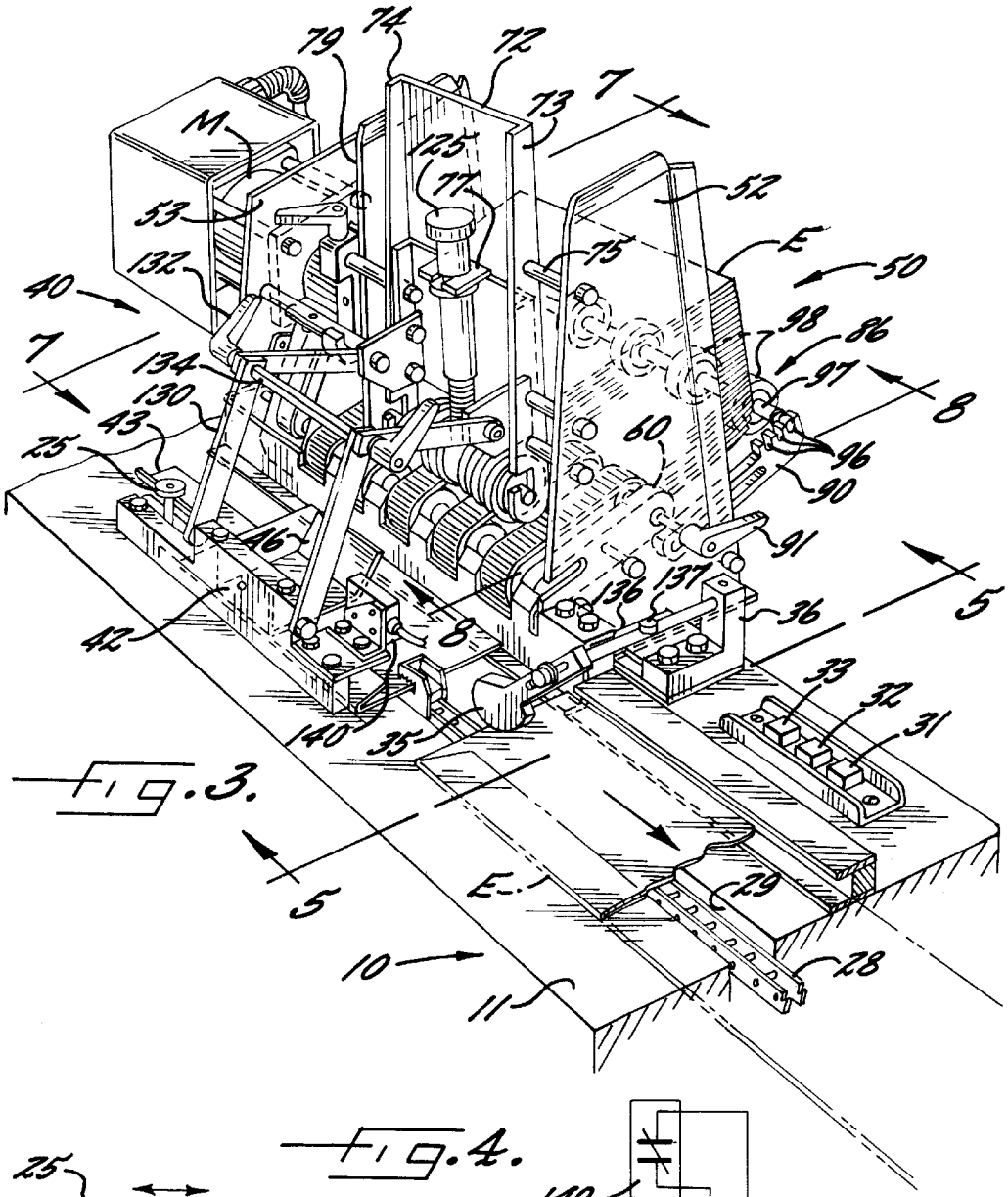
FIG. 3 is a fragmentary perspective view of an envelope feeding apparatus which embodies the features of the present invention.

FIGS. 1 and 2 illustrate the primary features of the Phillipsburg™ inserter which is representative of the prior art and which is presently being commercialized by the Bell & Howell Corporation. The inserter comprises a support table 10 having a generally flat upper surface 11, with an envelope hopper 12 mounted on the upper surface. The hopper 12 comprises a pair of parallel support bars 14, 15 which are bolted on the upper surface 11 so as to be laterally spaced apart from each other, and the support bars 14, 15 are longitudinally aligned with the downstream envelope processing stations (not shown). Also, the support bars 14, 15 include opposing inclined shoulders 16 as best seen in FIG. 2.

The hopper 12 further includes a horizontal open rectangular frame 18 positioned on the support bars 14, 15, and a plurality of vertical rods 19 extend upwardly from the frame 18 to define a rectangular receptacle for a stack of envelopes E. The frame 18 is sized so that the envelopes initially rest upon the edges of the frame 18 as seen in FIG. 2. Also, a pair of support pins 20 extend inwardly from the two ends of the frame to further support the envelopes in the position shown in FIG. 2.

A set of suction cups 22 is mounted below the hopper 12 for vertical reciprocation through a slot-like opening 23 in the upper surface 11 of the table 10, with the suction cups 22 being movable between an upper position shown in dashed lines in FIG. 2, and a lower position as shown in solid lines. Also, a kicker rod 25 is mounted for reciprocation in a longitudinal slot 26 in the upper surface of the table and so as to be movable between a withdrawn position outside of the hopper and a forward position within the hopper.

The apparatus further includes an endless conveyor chain 28 which has an upper run extending along a longitudinal slot 29 in the upper surface of the table, and so as to extend from one end of the hopper longitudinally to and through a plurality of processing stations, such as a flap opener, and an envelope stuffing device, which are not shown. The chain 28 mounts a plurality of spaced apart clamping jaws 30 (typically ten) along its length, and the jaws are configured to grip the leading edge of an envelope in the manner further described below.

The endless chain 28 is rotatably driven in a cyclical manner, so that the jaws 30 in the upper run cyclically index forwardly and then dwell, with the operation being controlled by three conventional control buttons, namely a start button 31, a jog button 32, and a reset button 33. Also, a guide bar 35 is mounted in a bracket 36 on the upper surface so as to guide the leading edge of the advancing envelope into the jaw which is momentarily located at the position shown in FIG. 1.

In operation, the envelopes are stacked in the hopper 12 with the flap side up and so as to rest on the ledge defined by the open frame 18 and the two pins 20. At the start of the cycle, the suction cups 22 move upwardly to contact the lowermost envelope of the stack, and a vacuum is automatically turned on, causing the suction cups to grip the lowermost envelope. The suction cups then move downwardly, causing the lowermost envelope to move downwardly and into engagement with the inclined shoulders 16 of the opposing support bars. The envelope then bows, until it moves past the inclined shoulders, and it then drops onto the upper surface 11. The vacuum in the suction cups is then turned off, leaving the envelope lying flat.

Next, the kicker rod 25 moves longitudinally into the hopper and pushes the envelope into the open jaw 30 on the conveyor chain 28 which is momentarily stationary in the position shown in FIG. 1, and the jaw then closes on the envelope. The chain is then indexed forwardly, pulling the envelope longitudinally toward the first of the processing stations, such as a flap opener, and the chain 28 again comes to rest. Another jaw 30 is then positioned as shown in FIG. 1, and in the meantime, the kicker rod 25 has moved back to its original position outside of the hopper, and the suction cups 22 have been vertically reciprocated to pull another envelope onto the upper surface. The kicker rod 25 then reciprocates forwardly to initiate the next cycle.

While the Phillipsburg™ inserter as described above is in widespread commercial use, it sometimes has difficulty consistently delivering envelopes which have warped and are not entirely planar. In this regard, it is well recognized that over time envelopes tend to warp, which causes their dimensions to change. As a result, the envelopes are not consistently handled upon withdrawal by the suction cups, and sometimes more than one is delivered onto the support table and sometimes none is delivered. This can result in significant problems and inefficiencies at the downstream processing stations.

DETAILED DESCRIPTION OF THE PREFERRED EMBODIMENT OF THE INVENTION

An envelope feeding apparatus which embodies the present invention is indicated generally at 40 in FIGS. 3–9. In the illustrated embodiment, the apparatus 40 constitutes a retrofit of the above-described prior art inserter, and thus the apparatus 40 of the invention has several components in common with the above described prior art apparatus. The common components which remain a part of the retrofit apparatus of the invention are indicated with common reference numerals. It should be understood, however, that the apparatus of the present invention could be fabricated from scratch.

The apparatus 40 of the present invention comprises the support table 10 of the prior art machine, and the structure and operation of the conveyor chain 28 and the kicker rod 25 are unchanged. However, the hopper 12 and the suction cup assembly of the prior art inverter are removed as part of the retrofit operation.

An elongate stop 42 is fixed to the upper surface at the location of the support bar 14 of the prior art hopper, and the same bolt holes may be utilized for securing the stop 42 to the table. This permits the stop 42 to maintain the necessary longitudinal alignment with the downstream envelope processing stations. Also, the opening 23 which accommodated the suction cups of the prior art machine is covered by an envelope guide plate 43, which includes an upwardly inclined lip 44 for the purposes described below, and a second envelope guide plate 46 is mounted to the stop 42 and includes an upwardly inclined forward edge 47.

Figure 9:
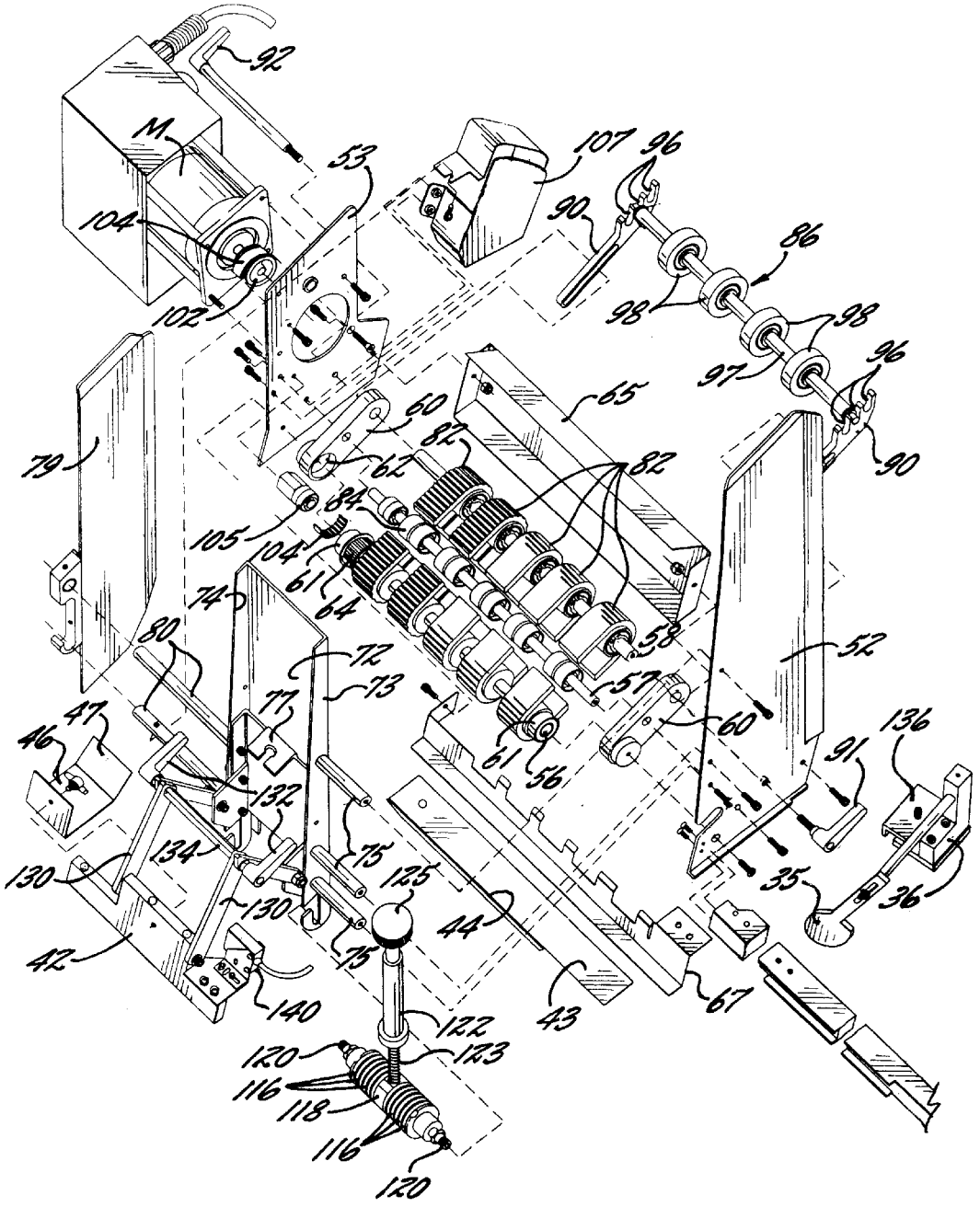
FIG. 9 is an exploded perspective view of the envelope feeder of the present invention.

The apparatus 40 further includes an envelope feeder 50 which comprises a rigid frame which includes a pair of upright side plates 52, 53 which rest directly on the upper surface 11 of the table, and three transverse rods 56, 57, 58 extend between and interconnect the side plates 52, 53. More particularly, and as best seen in FIG. 9, the three transverse rods 56, 57, 58 are supported at each of their ends by a retainer 60, and each retainer 60 includes two holes which permit the rods 57 and 58 to extend therethrough. The front rod 56 mounts a bearing 61 at each end, and each bearing 61 is secured in a receptacle 62 formed on the inside of the retainer 60. The forward rod 56 also mounts a drive sprocket 64 adjacent one of its ends, so as to permit the rod 56 to be rotatably driven in a manner further described below. The frame further includes a rear cover plate 65 which extends between the side plates 52, 53 and is connected thereto at the rear portion of the frame, as well as a front cover plate 67 which extends between the side plates 52, 53 adjacent the front of the frame. The front cover plate 67 extends in the longitudinal direction and is laterally opposite the stop 42, and an envelope receiving position is defined between the stop 42 and the front cover plate 67.

Figure 8:
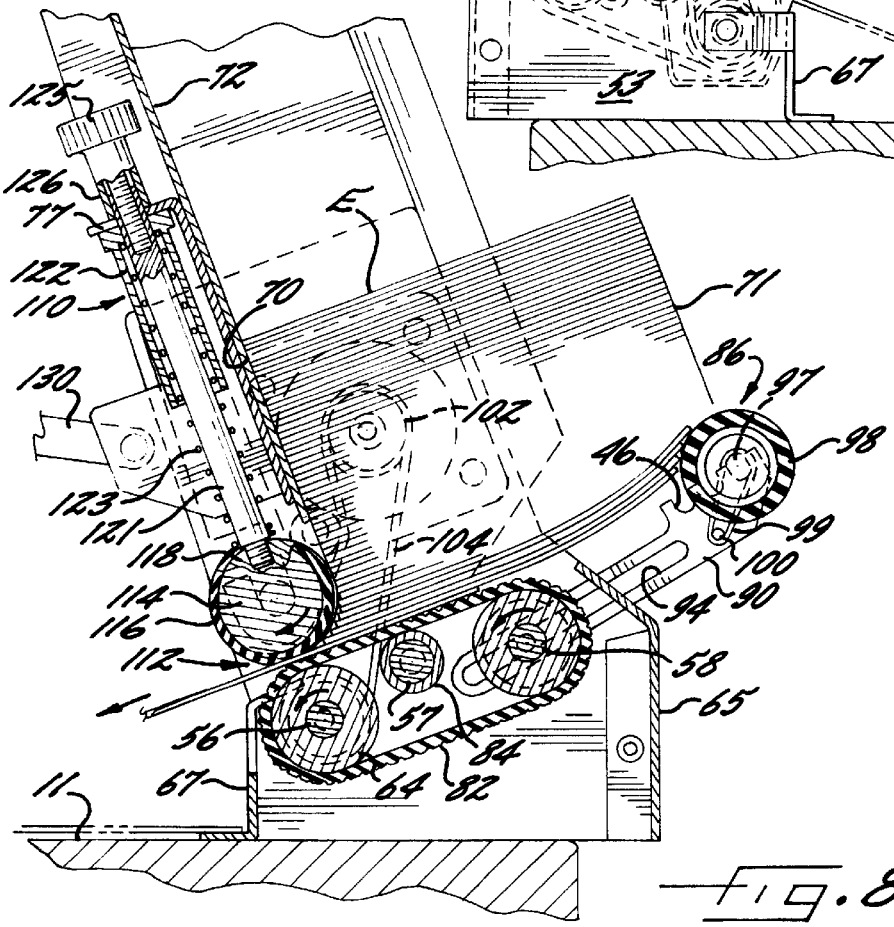
FIG. 8 is a sectional view taken substantially along the line 8—8 of FIG. 3.

The envelope feeder 50 further comprises means for supporting a generally vertical stack of rectangular envelopes E. As best seen in FIG. 8, the supported stack defines a forward side 70 composed of aligned forward edges of the envelopes, as well as the opposite rear side 71 composed of the aligned rearward edges of the sheets. The forward side 70 of the stack is supported in the forward direction by a generally vertically extending front support plate 72. The front support plate 72 includes inturned opposite sides 73, 74, and is fixedly secured to the frame by transverse rods 75 (FIG. 9) which are joined to the side plate 52. The upper portion of the support plate 72 includes a generally horizontal mounting bracket 77 having a forwardly extending slot for the purposes described below.

The stack supporting means further includes a side plate 79 which is slidably mounted on a pair of horizontal support rods 80, which are in turn mounted to the inturned side 74 of the front support plate 72, note FIG. 9. Thus in use, the envelopes may be positioned to register against the fixed side plate 52, and the other side plate 79 is adjusted so that the envelopes fit therebetween without undue play. Also, as explained above, the forward side of the stack rests against the front support plate 72.

The stack supporting means further includes endless belt means, which comprises, in the illustrated embodiment, five endless belts 82, mounted between the support rods 56 and 58. More particularly, the front and rear rods 56, 58 mount five aligned pairs of pulleys, which in turn support the five belts 82. The pulleys of the front rod 56 are fixed to the rod, while the rear pulleys are rotatably supported on the rear rod 58. The intermediate rod 57 in turn rotatably mounts five guide pulleys 84, with the guide pulleys 84 being disposed within respective ones of the belts so as to support the upper runs thereof. Thus, the rotation of the front rod 56 causes the belts 82 to rotate and thereby convey the envelopes forwardly to the nip area in the manner further described below.

It will be noted that in the illustrated embodiment, three of the belts 82 have a smooth exterior surface and are supported on crown pulleys. Two of the belts 82 include lateral grooves in the outer surface, and further include a ridge on the inner surface which sides in a groove in the supporting pulleys. The latter belts are not susceptible to walking off the supporting pulleys, and the lateral grooves in the outer surface are useful in handling products which shed fibers or other contamination. Either style may be used with the present invention.

The stack supporting means also includes a rear support member 86 which is joined to the two side plates. The rear support member 86 includes a pair of brackets 90 which are fixedly mounted to the side plates 52, 53 by means of handles 91, 92. The handles 91, 92 each include a bolt which extends through an opening in the associated side plate, and then through an elongate slot 94 of the associated bracket. The bolt then is threadedly engaged in a coaxial bore of the rear transverse rod 58, which extends through the rear hole of the retainer 60. Thus, upon loosening of the two handles 91, 92, the brackets 90 may be laterally shifted toward or away from the nip, and the elevation of the rear end portion of each bracket may also be shifted by rotation of the bracket about the axis defined by the rear rod 58.

The rear end portion of each of the brackets 90 includes three upwardly open notches 96, which define aligned pairs of notches 96 which are designed to receive the ends of a support rod 97 therebetween. The support rod 97 rotatably mounts four rollers 98 in the illustrated embodiment. The support rod 97 can thus be received in any one of the three aligned pairs of notches of the brackets, so as to permit the lateral spacing of the rollers 98 from the nip to be adjusted. The support rod 97 may be retained in the selected notches by an elastic band 94 which loops about the rod and a pin 100 FIG. 8 on the bracket. The lateral positioning of the rollers 98 can thus be adjusted by either (1) loosening the handles 91, 92 and sliding the brackets so that the bolts of the handles slide along the slots 94, (2) selecting the aligned pair of notches 96 which receive the support rod 97, or both of the above measures may be utilized. Accordingly, the rear support member 86 may be readily positioned so that the rear side 71 of the stack E rests upon the rollers 98 at a point short of the rotational axis of the rollers when viewed in side elevation as shown in FIG. 8. Thus, the weight of the stack tends to rotate the rollers in a direction to deliver the envelopes toward the nip.

The above-described structure and mounting of the rear support member 86 provides the further significant advantage of being able to adjust, both laterally and vertically, the position of the support member to accommodate envelopes of different size, and to also accommodate for any warpage of the envelopes. Thus, for example, in the event one lateral end edge of the envelopes in the stack is warped, causing its lateral dimension to be effectively shortened, the position of one of the brackets 90 can be shifted to accommodate that reduction in length, while maintaining proper support.

The five belts 82 are rotated by a driver system so that the upper runs move in a right to left (or forward) direction as seen for example in FIG. 8. This drive system includes an electric motor M which is mounted to the frame of the apparatus at a location outside of the side plate 53, and the output drive shaft of the motor mounts a drive sprocket 102. The drive system further includes an endless drive belt 104 entrained about the drive sprockets 64, 102. Also a follower roller 105 is mounted to the side plate so as to engage the belt 104 at a location between the sprockets 64, 102 to ensure proper and firm engagement therewith. A cover 107 is mounted to the side plate 53 for protectively covering the drive belt 104, and one end of the lower rod 80 is anchored to the cover 107 as seen in FIG. 9.

The apparatus 40 further includes a stationary gate forming member 110 positioned above the upper runs of the three belts, and adjacent the forward side 70 of the stack of envelopes, and so as to define a nip 112 between the gate forming member 110 and the upper runs of the belts 82. In the illustrated embodiment, the gate forming member comprises a generally cylindrical roll 114 defining a central axis and an outer peripheral surface which is concentric to the central axis. Also, the roll 114 has a plurality of annular grooves extending about the circumference thereof, with the grooves being disposed about a second axis which is parallel to and offset from the central axis in a direction parallel to the forward direction. Thus the grooves are relatively deep along a first half of the peripheral surface of the roll, and relatively shallow along a second half of the peripheral surface.

As mounted on the apparatus 40, the peripheral half having the relatively deep groove portions faces rearwardly toward the stack of envelopes, and the peripheral half having the relatively shallow groove portions faces forwardly. Also, a transition between the first and second halves is located adjacent the nip 112, and the other transition is located diametrically opposite the nip. The roll 114 further includes a ring 116 disposed in each of the grooves, with the rings 116 being composed of an elastomeric material having a higher coefficient of friction than that of the material of the roll 114. Also, the rings 116 are sized so as to lie radially inside of the peripheral surface of the roll about the rearwardly facing half thereof, and to extend radially beyond the peripheral surface about the forwardly facing half thereof. As best seen in FIG. 8, and following the periphery of the roll and rings in a clockwise direction, it will be seen that the rings 116 initially extend slightly beyond the peripheral surface at the nip 112, and along the half of the periphery facing away from the stack they extend beyond the peripheral surface of the roll. At the location diametrically opposite the nip, the rings recede within the periphery of the roll, and they stay within the periphery of the roll along the rearwardly facing half of the periphery.

The apparatus 40 includes means for mounting the roll 114 so as to permit the dimension of the nip 112 between the roll 114 and endless belts 82 to be adjusted. The ability to adjust the nip allows for the single feeding of various thicknesses of envelopes or sheets. More particularly, the roll 114 includes a central portion 118 which does not include the grooves and rings, and a threaded radial opening which extends into the central portion, note FIG. 9. Also, the opposite ends of the roll include coaxial mounting posts 120, which are received within respective ones of the vertically extending slots positioned in the lower ends of the sides 73, 74 of the front support plate 72. A rod 121 having a threaded lower end is threadedly received in the opening of the central portion 118 of the roll 114, and the rod 121 includes an upper portion which extends through the slot in the mounting bracket 77. This upper end portion is formed with an internally threaded axial bore, and a sleeve 122 and a spring 123 coaxially surround the rod 121 below the mounting bracket, with the sleeve 122 having an upper end which engages the underside of the bracket 77. The spring 123 is under compression, so as to bias the roll 114 downwardly with respect to the bracket 77. This downward movement is limited by a control knob 125 which has a threaded member engaged in a bore at the upper portion of the rod 121, and an outer concentric sleeve 126 for engaging the upper side of the mounting bracket 77. Thus rotation of the control knob 125 tends to raise or lower the roll 114 with respect to the bracket 77, and to thus change the vertical dimension of the gap at the nip 112 formed between the roll 114 and the endless belts 82. Also, the spring 123 will be seen to bias the roll toward the nip and it permits limited upward movement of the roll 114 away from the nip and against the force of the spring.

The above-described mounting means for the roll 114 also permits the quick release and removal of the roll assembly which includes the roll 114, rod 121, sleeve 122, and control knob 125, to thereby facilitate replacement or rotational adjustment of the rings 116. More particularly, the assembly may be released and removed by lifting the roll 114 so that the mounting post 120 are removed from the slots in the sides 73, 74 of the plate 72, and then slipped forward from the slot in the bracket 77.

The roll 114 and its mounting structure are further described in U.S. Pat. No. 4,991,831, the disclosure of which is incorporated herein by reference. It will be understood however that other constructions of the components are also possible, as illustrated for example in U.S. Pat. Nos. 5,244,198 and 5,143,365, the disclosures of which are also incorporated herein by reference.

Figure 5:
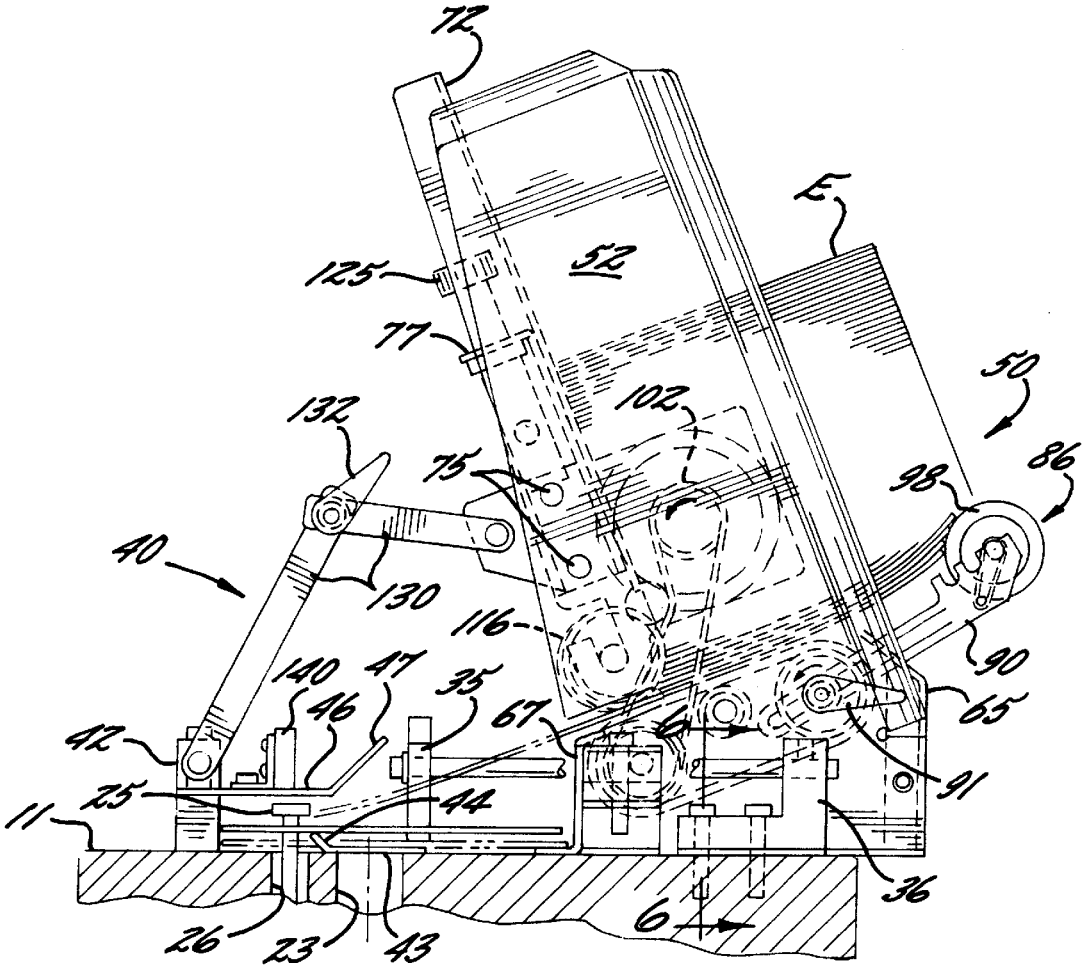
FIG. 5 is a sectional side elevation view taken substantially along the line 5—5 of FIG. 3.

The apparatus 40 further comprises sheet guide means positioned downstream of and in registry with the nip 112 for guiding the sheets forwardly after advancing through the nip. This sheet guide means, as best seen in FIG. 5 includes the upper inclined lip 44 of the guide plate 43, as well as the upwardly inclined lip of the second guide plate 46. The lip 44 serves to insure that the leading edge of the delivered envelope does not engage in the slot 26 of the kicker rod 25. The inclined lip 47 serves to insure that the leading edge of the delivered envelope does not lift upwardly and is properly directed into engagement with the stop 42. The lips 44 and 47 are particularly useful where warped envelopes are being processed, and where the leading edges of the advancing envelopes may lie above or below the normal path from the nip 112 to the stop 42.

During the sheet feeding operation, it is preferred that the gap formed at the nip 112 be adjusted such that the lowermost envelope of the stack is free to pass through the nip without engaging the rings 116 and thus without significant frictional resistance, while the envelope immediately above the lowermost envelope engages the rings 116 of the roll 114 and is retarded by the increased frictional resistance provided by the rings. Thus the envelopes above the lowermost envelope are held substantially stationary in the stack. Also, the rear support member 86 is positioned so as to slightly lift the rear side of the stack from the upper run of the endless belts 82 and to encourage the forward movement of the lowermost envelopes by the rotation of the rollers 98.

The feeder is adjustably interconnected to the support table so as to permit the lateral spacing between the front cover plate 67 of the feeder and the stop 42, to be adjusted to thereby vary the lateral dimension of the envelope receiving position and accommodate envelopes of varying size. This interconnection comprises a pair of pivotable linkages which directly interconnect the sides 73, 74 of the support plate 72 of the feeder and the stop 42, with the linkages 130 each including a releasable, locking lever 132 for locking the same so as to preclude relative pivotal movement and thus provide a selected lateral dimension. The two locking levers 132 are threadedly joined to a common transverse rod 134, so that when the levers 132 are tightened, relative pivoting, and expansion or contraction of the length of the linkages 130, are precluded.

Figure 6:
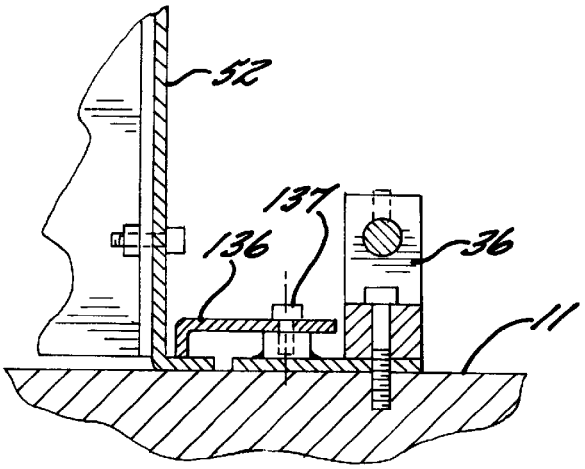
FIG. 6 is a fragmentary sectional view taken substantially along the line 6—6 of FIG. 5.
Figure 7:
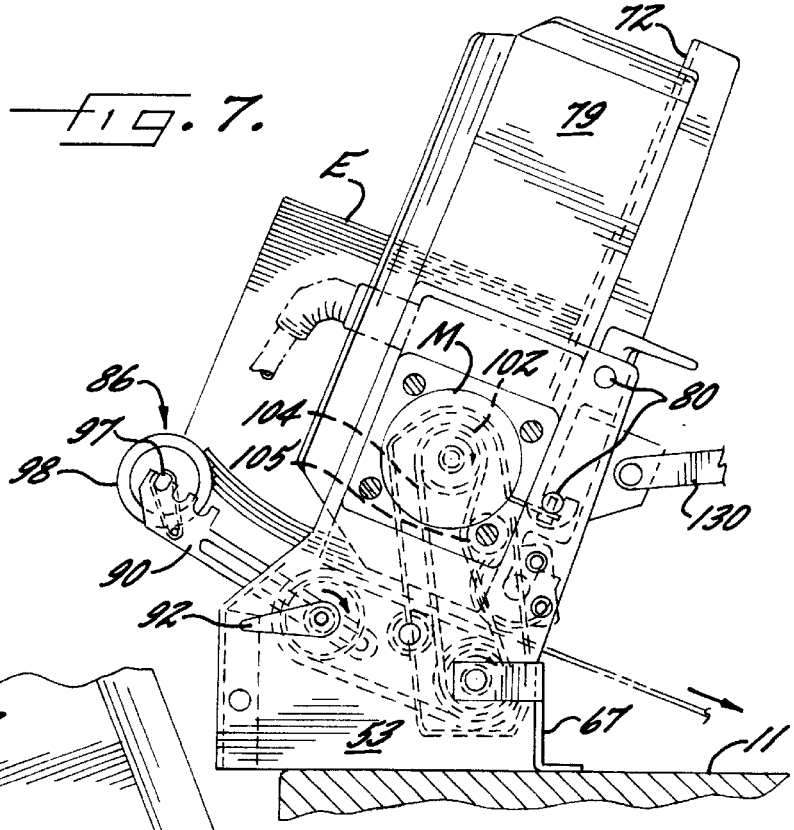
FIG. 7 is a fragmentary side elevation view taken substantially along the line 7—7 of FIG. 3.

As best seen in FIG. 6, a clamping channel 136 is also provided to assist in securing the feeder in a selected lateral position, and so as to permit the lateral dimension of the envelope receiving position to be adjusted to accommodate envelopes of differing size. The clamping channel 136 includes a locking bolt 137, which is threadedly mounted in a boss which is fixed to a plate 138 which underlies the bracket 36, and which when tightened, causes the channel to bear against the out-turned bottom edge of the side plate 52. Thus, to adjust the lateral positioning of the feeder, the locking levers 132 and the clamping bolt 137 are loosened, and the feeder may then be slid laterally, while being guided in such lateral movement by the linkages 130. Such lateral sliding movement is possible, since the side plates 52, 53 of the feeder preferably merely rest upon the upper surface 11 of the support table 10, without being directly bolted or otherwise fixed thereto. When the desired position is reached, the locking levers 132 and the clamping bolt 137 are retightened to secure the feeder in its desired position.

Figure 4:
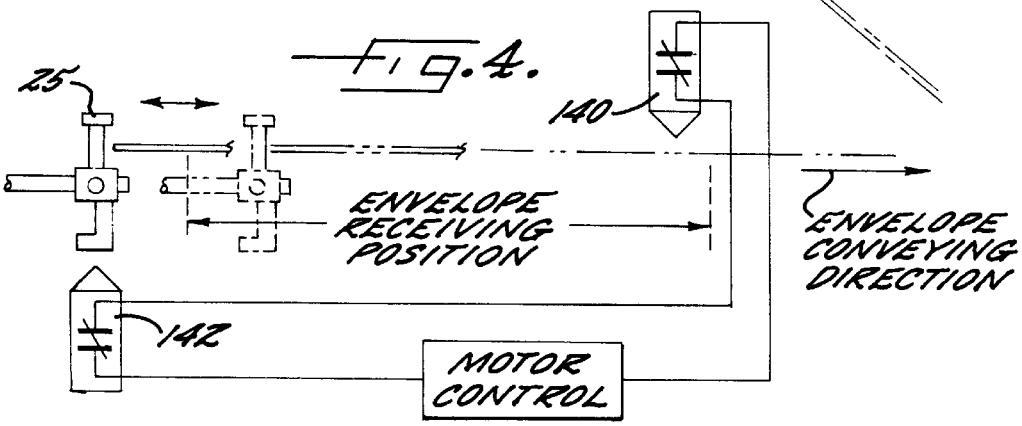
FIG. 4 is a schematic circuit diagram illustrating the motor control system for the apparatus shown in FIG. 3.

The operation of the drive motor M for controlling the rotation of the belts 82, and thus the advance of the envelopes, is illustrated schematically in FIG. 4. As illustrated, a sensor 140 is mounted on the stop 42 for sensing the presence or absence of an envelope in the envelope receiving position, and a second sensor 142 is provided for sensing the presence or absence of the kicker rod 25 in its withdrawn position. The circuit is closed when the first sensor 140 senses the absence of an envelope in the envelope receiving position and the second sensor 142 senses that the kicker rod 25 is in its withdrawn position, which is outside of the envelope receiving position as illustrated in solid lines in FIG. 4. The closing of the circuit results in the motor M cycling until an envelope is delivered to the envelope receiving position. The sensor 140 then opens the circuit to prevent further delivery of envelopes, until the kicker rod 25 and conveyor chain 28 have longitudinally conveyed the delivered envelope from the envelope receiving position in the manner described above.

In the drawings and the specification, there has been set forth preferred embodiments of the invention and, although specific terms are employed, the terms are used in a generic and descriptive sense only and not for purpose of limitation. For example, the apparatus has been described as being designed to deliver and process envelopes, but it will be understood that the invention may be used with other sheet-like products. The scope of the invention is set forth in the following claims.

That which is claimed is:

1. An apparatus for serially feeding envelopes along a path of travel so as to facilitate the further processing thereof, and comprising a support table which includes a generally flat upper surface, an envelope stop fixed to said upper surface so as to define a longitudinal direction and a lateral direction which is perpendicular thereto, envelope feeder means positioned on said upper surface of said support table at a location laterally spaced from said stop so as to define an envelope receiving position therebetween, and for serially delivering envelopes in the lateral direction into engagement with the stop and so as to overlie the envelope receiving position, envelope conveying means mounted to said support table for conveying each envelope received at the envelope receiving position along a longitudinal path of travel on the upper surface, means adjustably interconnecting the envelope feeder means and said support table so as to permit the lateral spacing between said envelope feeder means and said stop to be adjusted to thereby vary the lateral dimension of the envelope receiving position and accommodate envelopes of varying size, said means adjustably interconnecting the envelope feeder means and the stop including adjustable linkage means directly interconnecting the stop and the envelope feeder means, with said linkage means having a variable lateral dimension and including locking means for locking the same in a selected lateral dimension, and wherein said envelope feeder means includes a feeder having a frame which rests upon said upper surface of said support table so as to permit sliding movement of said feeder on said upper surface when said locking means is released, and such that the linkage means maintains the alignment of the feeder with the stop during such sliding movement.

2. The apparatus as defined in claim 1 further comprising clamp means for securing said frame of said feeder to said upper surface, and whereby the locking means and the clamp means are adapted to releasably secure the feeder in a selected lateral position.

3. The apparatus as defined in claim 1 wherein said envelope conveying means comprises an endless conveyor mounted for movement in a longitudinal direction along said upper surface of said support table, drive means for intermittently advancing the conveyor, a plurality of gripping jaws mounted in a spaced apart arrangement on said conveyor, a kicker rod mounted to said support table for longitudinal reciprocation between a position longitudinally withdrawn from said envelope receiving position and an advanced position within said envelope receiving position, and means for coordinating the movement of said kicker rod and said conveyor so that an envelope received in said envelope receiving position is gripped by one of said jaws and conveyed along a longitudinal path of travel from said envelope receiving position.

4. The apparatus as defined in claim 3 wherein said kicker rod is guided along a longitudinal slot extending through said upper surface of said support table, and wherein said apparatus further comprises a guide plate positioned on said upper surface within said envelope receiving position, said guide plate including an upwardly inclined lip which is parallel to and adjacent said longitudinal slot so as to lift the forward edge of an envelop advancing from said feeder toward said stop and thereby prevent the forward edge from engaging the longitudinal slot.

5. The apparatus as defined in claim 4 further comprising a second guide plate fixed to said stop so as to be positioned above said envelope receiving position, said second guide plate having an upwardly inclined lip facing said feeder and so as to prevent the forward edge of an envelope advancing from the feeder toward said stop from lifting above said stop.

6. The apparatus as defined in claim 3 wherein said feeder comprises means for supporting a generally vertical stack of envelopes and so that the stack defines a forward side composed of aligned forward edges of the envelopes, and a bottom, said supporting means including an endless belt and means rotatably mounting said endless belt so as to have an upper run positioned to extend across the bottom of said stack;

drive means for rotating said endless belt so that said upper run moves in a forward direction; and means including a stationary gate forming member positioned above said upper run of said belt and adjacent the forward side of said stack and so as to define a nip which forms a gap between said gate forming member and said upper run, for permitting the lowermost envelope of the stack to pass forwardly from the stack through said nip, said gate forming member including a first surface facing toward said forward side of said stack so as to engage the forward edges of the envelopes in the stack, and second surface at said nip and having a coefficient of friction which is higher than that of said first surface, and such that the lowermost envelope is free to pass through said nip without significant frictional resistance while the envelope immediately above the lowermost envelope is retarded in moving through said gap by its frictional engagement with said second surface.

7. The apparatus as defined in claim 6 wherein said feeder further comprises motor control means for sensing the presence or absence of an envelope in said envelope receiving position, for sensing the presence or absence of said kicker rod in said withdrawn position, and for activating said drive means upon both the absence of an envelope in said envelope receiving position and the kicker rod being in its withdrawn position.

8. The apparatus as defined in claim 6 wherein said stack defines a rear side which is opposite said forward side, and said stack supporting means of said feeder further includes a rear support member positioned rearwardly of the upper run of said belt so as to underlie the rear side of said stack.

9. The apparatus as defined in claim 8 wherein said rear support member comprises a pair of brackets mounted to said frame, a support rod supported between said brackets, and a plurality of rollers mounted to said support rod for engaging the rear side of said stack of envelopes.

10. The apparatus as defined in claim 9 further comprising means adjustably mounting said pair of brackets of said rear support member to said frame for adjustable movement in the direction of movement of said endless belt and so as to permit the apparatus to accommodate envelopes of different size.

11. The apparatus as defined in claim 10 wherein said pair of brackets of said rear support member include a plurality of aligned pairs of upwardly open notches, with each aligned pair of notches being configured to selectively receive the ends of the support rod, and so that the position of the support rod may be adjustably positioned to accommodate envelopes of different size.

12. The apparatus as defined in claim 6 further comprising means adjustably mounting said gate forming member so as to permit the dimension of said nip to be adjusted.

13. The apparatus as defined in claim 12 wherein said means adjustably mounting said gate forming member includes spring biasing means for biasing said member toward said nip and for permitting limited movement of said member away from said nip and against the force of said spring biasing means.

* * * * *